US005096226A

United States Patent [19]

Steffen

[11] Patent Number: 5,096,226

[45] Date of Patent: Mar. 17, 1992

[54] LABEL

[76] Inventor: Fritz Steffen, Mühlenweg 22, 4902 Bad Salzuflen, Fed. Rep. of Germany

[21] Appl. No.: 532,587

[22] Filed: Jun. 4, 1990

[30] Foreign Application Priority Data

Jun. 22, 1989 [DE] Fed. Rep. of Germany ..... 3920496

[51] Int. Cl.[5] ..... B42D 15/00

[52] U.S. Cl. ..... 281/5; 283/81; 428/40; 40/299; 40/306

[58] Field of Search ..... 40/306, 299, 638; 229/70, 92.1, 92.8; 206/831

[56] References Cited

U.S. PATENT DOCUMENTS

| | | | |
|---|---|---|---|
| 2,706,865 | 4/1955 | Miller | 283/81 |
| 2,723,078 | 11/1955 | Tilly | 229/92.8 |
| 4,097,067 | 6/1978 | Schechter | 229/70 |
| 4,428,526 | 1/1984 | Riley | 229/92.8 |
| 4,529,229 | 7/1985 | Glibbery | 428/40 |
| 4,592,572 | 6/1986 | Instance | 40/638 |
| 4,621,442 | 11/1986 | Mack | 40/306 |
| 4,645,241 | 2/1987 | Sfikas | 229/70 |
| 4,660,856 | 4/1987 | Shacklett, Jr. | 229/92.1 |
| 4,830,406 | 5/1991 | Instance | 428/40 |
| 4,850,611 | 7/1989 | Skelton | 281/5 |
| 4,865,352 | 9/1989 | Gollon | 40/299 |
| 5,031,938 | 7/1991 | Instance | 283/81 |

FOREIGN PATENT DOCUMENTS

| | | | |
|---|---|---|---|
| 659854 | 10/1951 | United Kingdom | 40/306 |

*Primary Examiner*—Kenneth J. Dorner
*Assistant Examiner*—Cassandra Hopp
*Attorney, Agent, or Firm*—Michael L. Dunn; Arthur S. Cookfair

[57] ABSTRACT

A label for sticking or sealing on an object is characterized in that is comprises at least three (a, b, c) panel portions (1) which are connected together in a row by fold lines (2), wherein the third panel portion (c) in the row is folded over in plane-parallel relationship on to the second panel portion (b) and in a direction normal to the fold lines (2) is narrower than the second panel portion (b) and the first panel portion (a) in the row is folded over in plane-parallel relationship on to the third panel portion (c) and secured thereto.

8 Claims, 2 Drawing Sheets

LABEL

The invention relates to a label for sticking or sealing on an object such as for example containers of any kind such as tins, glasses, bottles, cardboard packs or the like, or other objects such as books, magazines or the like.

As is known, labels of that kind are used for labelling containers of any shape and nature in order to provide information about the contents thereof. For example such labels show the trade name or the type designation or the name of the producer of the content of the container or the name of the person putting such content into the container. Such labels may also carry a prescription or recipe or recommendations in regard to use or more detailed information about the composition of the product. As is known such labels are applied to the object for example by pressure-activatable or heat-activatable adhesives. The labels may also be sealed on to the objects when the objects are plastics objects or are plastics-coated.

In some cases, in addition to the label surface, it may be desirable to have a further surface which can be printed upon, without having to stick additional labels on to the object, as additional labels of that kind would have an adverse effect on the appearance of the object. An additional surface which can be printed upon, of that kind, may be used for example to provide additional information about the product or to set out a number of different instructions regarding use of the product or to represent a detachable discount voucher or a similar lottery ticket or pictures for collection thereon. Particularly in regard to pictures for collection or lottery tickets or the like, it is desirable for them to be kept covered from the point of view of the purchaser until he has purchased the articles and can himself remove the covering.

Accordingly the underlying problem of the invention is that of providing a iabel for sticking or sealing on an article, which in addition to the label surface offers further surfaces which can be printed upon and which are readily accessible to the user and which can possibly be detached. The invention also seeks to provide in particular that the additional surface which can be printed upon is concealed prior to being made accessible or prior to detachment, in order to provide a surprise.

The label according to the invention for sticking or sealing on an article is characterised in that it comprises at least three panel portions which are connected together in a row by fold lines, wherein the third panel portion in the row is folded over in plane-parallel relationship on to the second panel portion and in a direction normal to the fold lines is narrower than the second panel portion and the first panel portion in the row is folded over in plane-parallel relationship on to the third panel portion and secured thereto.

The panel portions which adjoin each other in the row will usually be of substantially the same form with the exception of a slight reduction in length of at least the third panel portion relative to the second panel portion in a direction normal to the fold lines. However the invention does not exclude the possibility of the panel portions also being of different shapes. For example the panel portion which is on the outside after the label has been stuck on the object may be longer than the panel portions beneath same, as considered in the direction of the fold lines, or conversely the subjacent panel portions may be longer than the covering panel portion and thus project beyond same in the form of a flap portion. The panel portions may be of any desired configuration, while the fold lines are preferably straight lines in order to facilitate the folding operation. Examples of shapes of labels are panel portions which are rectangular or rounded off at the upper and/or at the lower ends or panel portions which converge in a pointed configuration or polygonal panel portions.

By virtue of the folding and configuration of the panel portions, in accordance with the invention, the label is in the form of a wound folded configuration or a pack consisting of a plurality of portions disposed one upon the other, being closed at both sides thereof along the fold lines of the second panel portion. When the label is stuck on to an article in that form, as for example with the first panel portion in the row, which in turn is fixed on the third panel portion in the row, then in that condition the label presents a single surface which can be printed upon, as in the case of conventional labels. However the label is opened up by being cut along at least one of the fold lines, and thus presents further surfaces which can be printed upon.

As the individual panel portions which are possibly to be detached in the form of discount vouchers, a picture or device to be collected, a lottery ticket or a suggested recipe, are all connected together in the original condition, there is also no risk that one of the panel portions comes loose or drops out or is removed without authorisation, during transportation or prior to the object being sold to the final consumer.

As furthermore the third panel portion which is folded in between the first and second panel portions in the row is narrower than the second panel portion, in a direction normal to the fold lines, the folding operation does not give rise to any upsetting or squashing effect so that the panel portions can all lie one upon the other really in plane-parallel relationship.

Generally the labels according to the invention are stuck on the article with the outward side of the first panel portion while the first panel portion is secured by way of its inward side to the third panel portion. That securing effect can be achieved in the usual manner by glueing or by virtue of a sealing connection, and the securing effect is preferably over the entire surface areas involved. As after the label is stuck on to the object, the first panel portion in the row is still concealed, even when the label is cut open in the proper fashion, the first panel portion can safely be smaller than the second panel portion without adversely affecting the visual impression. That may be desirable for reasons concerned with the production procedure or for other reasons. Obviously, even if not preferred, the label may also be secured to the object by glueing or sealing, with the outward side of the second panel portion.

If the label according to the invention only consists of three panel portions, then, in addition to the side of the cover panel portion which is disposed outwardly in the closed position, only two further panel portion surfaces which can be printed upon are available after the label has been opened. That may be sufficient for example if one of the panel portions which can be detached along the two fold lines of the second panel portion, serves as a lottery ticket, discount voucher or picture to be collected.

In many cases however it is desirable to have larger printable surfaces concealed in the label, such as for example in order to print out a plurality of images for collection, or a series of instructions for use. In that case, the label preferably includes at least one further panel portion which adjoins the third panel portion in the row by way of a respective fold line and which, like the first panel portion in the row, in a direction normal to the fold lines, is narrower than the second panel portion and is folded in between the second and third panel portions in plane-parallel relationship. When mention is made herein, in connection with the various panels, of the fact that they are to be narrower than the second panel portion, that means any desired difference in width in a direction normal to the fold lines, although generally speaking very slight differences in width are sufficient to prevent the material from being upset or squashed when folded, for example differences in width of ½ to 1 mm.

Many embodiments preferably provide that adjoining the third panel portion in the row are a plurality of additional panel portions which are connected together by way of respective fold lines, the number of such panel portions being restricted only by the conditions of practical use. The panel portions adjoining the third panel portion may be folded together in the form of a zig-zag folded configuration or a wound folded configuration or with a combination of both kinds of folding. The multi-layer pack which is formed thereby is inserted at any event between the third and second panel portions in order to provide a closed line prior to opening of the label along the fold lines of the second panel portion, so that the other panel portions are prevented from falling out.

In order to make the additional printable surface in the interior of the label accessible, the user only needs to cut one of the fold lines of the second panel portion open with a knife or letter opener or the like, so that the label can be unfolded and the other panel portions can fall out or be folded out. After that, those panel portions can be detached as a whole or individually by tearing or cutting along the fold lines. In order to make it easier to open the label and detach the panel portions, it is preferred for the fold lines to consist of perforated lines. The label can be opened by pressing against the one perforated fold line of the second panel portion, for example by means of a letter opener or the back of a knife. The panel portions can be detached by simply being torn off along the perforated lines.

It is self-evident that panel portions of an elongate configuration may be connected together by way of fold lines both along their long sides and also along their short sides.

The invention is illustrated in further detail by reference to the drawing in which.

Figure 1:
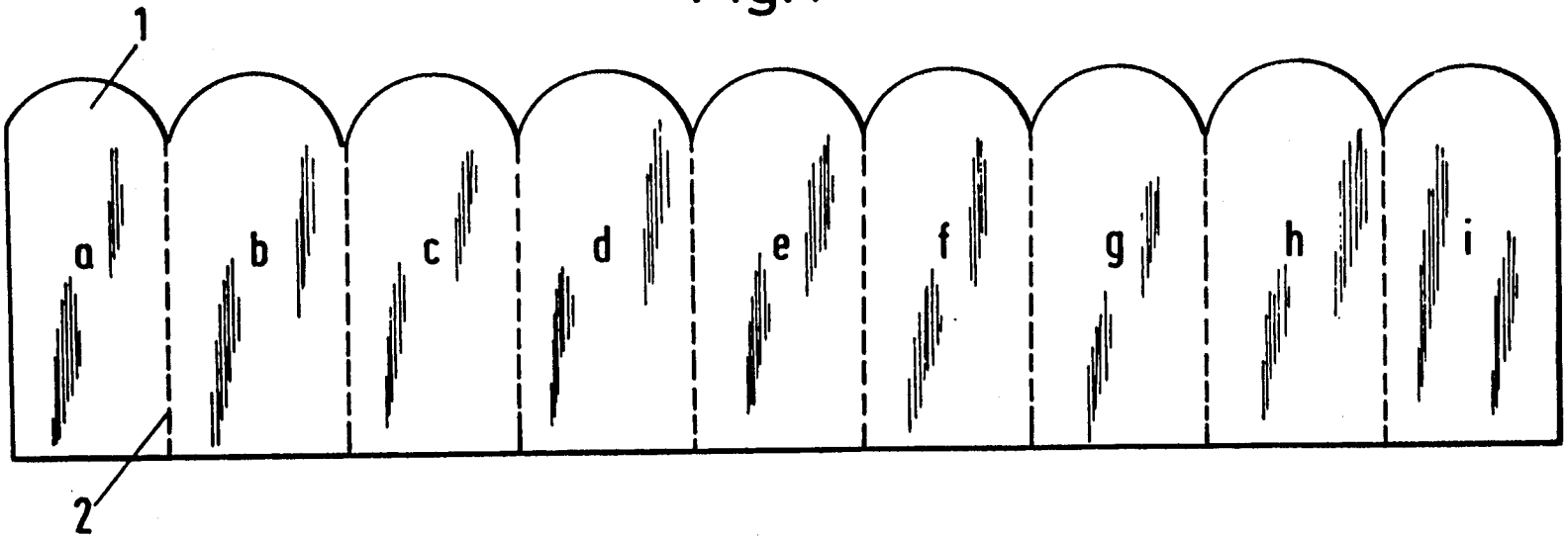
FIG. 1 is a plan view of a blank of a label according to the invention prior to folding and glueing thereof.

The blank shown in FIG. 1 comprises nine panel portions which are identified by letters a to i. Panel portions a to c are necessary in accordance with the invention. The individual panel portions are identified by reference numeral 1 while the perforated fold lines between each two panel portions are identified by reference numeral 2.

When the blank is folded, the panel portions d to i are folded one upon the other in plane-parallel relationship in a zig-zag configuration and/or in the form of a wound folded configuration. The pack which is formed in that way is then folded on to the panel portion c and with the latter on to the panel portion b, whereupon the panel portion a is then folded over on to the rear side of the upwardly disposed panel portion c and then glued thereto over the entire surface area involved.

Figure 2:
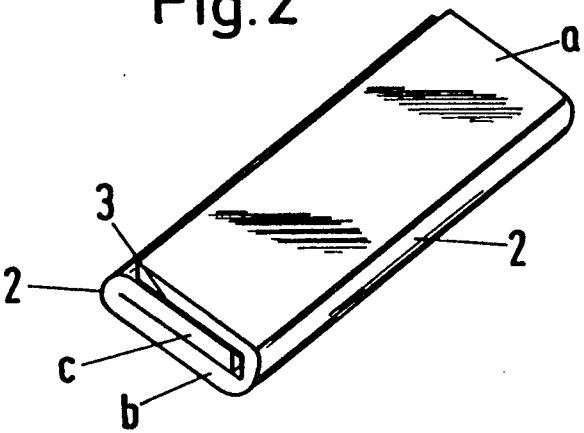
FIG. 2 is a perspective view of a folded and glued label according to the invention in another embodiment.

In the embodiment shown in FIG. 2, for the sake of clarity, the label has only three panel portions a, b and c, with the thicknesses of the layers forming the panel portions being shown on an exaggerated scale to make the drawing clearer.

It will be seen from FIG. 2 that the panel portions a and c are narrower than the panel portion b. The panel portion c is firstly folded over on to the panel portion b in plane-parallel relationship thereto, whereupon the panel portion a is folded on to the panel portion c and glued thereto over the entire surface area involved. The layer of adhesive is indicated by reference numeral 3.

Figure 4:
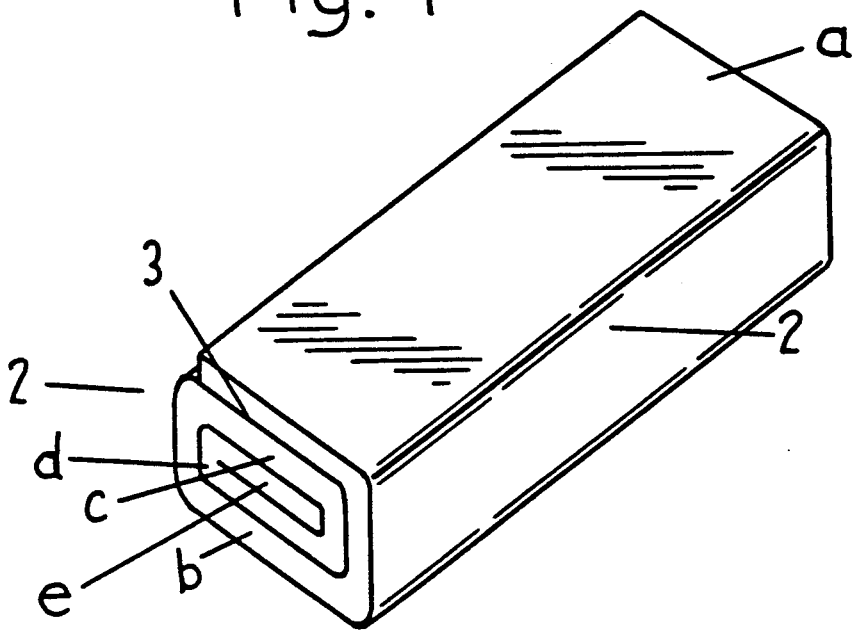
FIG. 4 is a perspective view of a label of the invention having interior wound folds.
Figure 3:
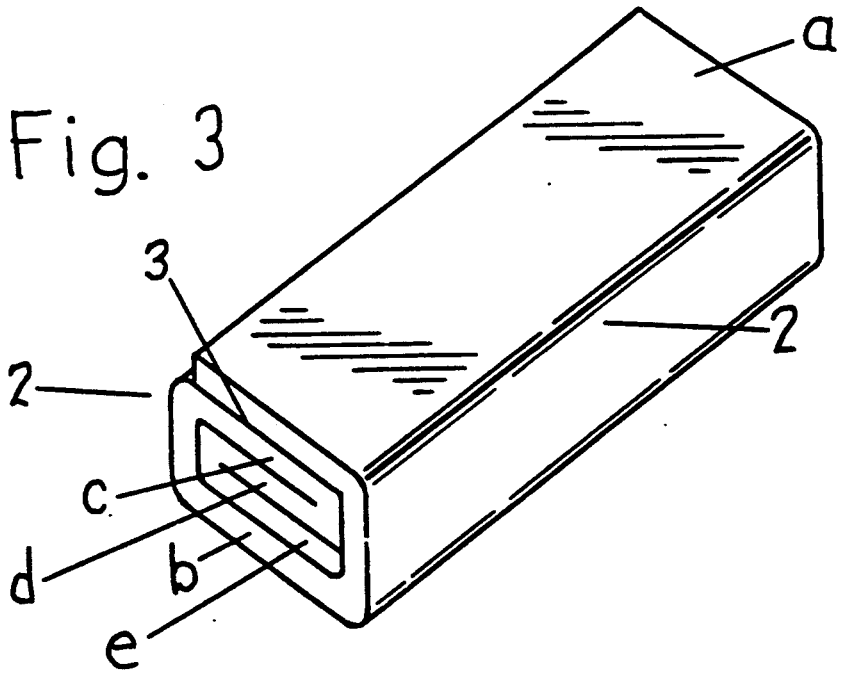
FIG. 3 is a perspective view of a label of the invention having interior zig-zag folds.

FIG. 2 clearly shows that the label is closed at its two longitudinal sides and can be opened only when one of the fold lines 2 is cut or torn open. If a label is produced with more than three panel portions, it looks similar to that shown in FIG. 2, with the other panel portions being disposed between the panel portions b and c in the form of a zig-zag folded configuration c-d-e as shown in FIG. 3, and/or a wound folded configuration c-d-e as shown in FIG. 4.

I claim:

1. A label for sticking or sealing on an object comprising at least three panel portions each of which has inward and outward sides and which are connected together in a row by perforated fold lines, wherein the third panel portion in said row is folded over in plane-parallel relationship on to the second panel portion and, in a direction normal to the fold lines, said third panel portion being narrower than said second panel portion, and wherein the first panel portion in said row is folded over in plane-parallel relationship on to said third panel portion and fixed thereon substantially over the entire area of its inward side, and the outward side of the first or second panel portion is able to be stuck or sealed to an object.

2. A label according to claim 1 characterized in that said first panel portion is narrower than said second panel portion in a direction normal to said fold lines.

3. A label according to claim 1 characterized in that, adjoining said third panel portion in said row by way of a respective one of said fold lines, is at least one further panel portion which is narrower than said second panel portion in a direction normal to said fold lines, and which is folded in between said second panel portion and said third panel portion in plane-parallel relationship.

4. A label according to claim 2 characterized in that, adjoining said third panel portion in said row by way of a respective one of said fold lines, is at least one further panel portion which is narrower than said second panel portion in a direction normal to said fold lines, and which is folded in between said second panel portion and said third panel portion in plane-parallel relationship.

5. A label according to claim 3 characterized in that it has a plurality of said further panel portions which adjoin said third panel portion in said row and which are each connected together by way of at least one of said fold lines, and which are folded on to each other in the form of a zig-zag fold configuration and lie between said second panel portion and said third panel portion.

6. A label according to claim 4 characterized in that it has a plurality of said further panel portions which adjoin said third panel portion in said row and which are each connected together by way of at least one of said fold lines, and which are folded on to each other in the form of a zig-zag fold configuration and lie between said second panel portion and said third panel portion.

7. A label according to claim 3 characterized in that it has a plurality of said further panel portions which adjoin said third panel portion in said row and which are each connected together by way of at least one of said fold lines, and which are folded on to each other in the form of a wound fold configuration and lie between said second panel portion and said third panel portion.

8. A label according to claim 4 characterized in that it has a plurality of said further panel portions which adjoin said third panel portion in said row and which are each connected together by way of at least one of said fold lines, and which are folded on to each other in the form of a wound fold configuration and lie between said second panel portion and said third panel portion.

* * * * *